US012692865B1

(12) United States Patent
Sabha

(10) Patent No.: US 12,692,865 B1
(45) Date of Patent: Jul. 28, 2026

(54) ELECTRIC COMPRESSOR WITH INTEGRATED VAPOR INJECTION CIRCUIT

(71) Applicant: MAHLE INTERNATIONAL GMBH, Stuttgart (DE)

(72) Inventor: Nick George Sabha, Lewiston, NY (US)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 19/039,424

(22) Filed: Jan. 28, 2025

(51) Int. Cl.
*F04C 18/02* (2006.01)
*F04C 27/00* (2006.01)
*F04C 29/12* (2006.01)

(52) U.S. Cl.
CPC ..... *F04C 18/0215* (2013.01); *F04C 27/005* (2013.01); *F04C 29/128* (2013.01)

(58) Field of Classification Search
CPC .. F04C 18/0215; F04C 23/008; F04C 29/042; F04C 18/0261; F04C 29/128; F04C 14/06; F04C 2/025; F04C 2210/26; F04C 2240/30; F04C 2240/60; F04C 2270/72; F04C 27/008; F04C 28/06; F04C 28/16; F04C 28/24; F01C 1/322; F01C 11/008; F01C 20/16
See application file for complete search history.

(56) References Cited

U.S. PATENT DOCUMENTS

| | | | | |
|---|---|---|---|---|
| 9,651,044 | B2 | 5/2017 | Suitou et al. | |
| 10,436,194 | B2 | 10/2019 | Nagata | |
| 11,384,759 | B2 * | 7/2022 | Bhatia | F04C 29/042 |
| 11,898,558 | B2 * | 2/2024 | Lee | F04C 29/0007 |
| 12,006,938 | B1 * | 6/2024 | Crenshaw | F04C 28/16 |
| 2015/0139818 | A1 * | 5/2015 | Nagata | F04C 28/06 417/45 |
| 2022/0290668 | A1 | 9/2022 | Lee et al. | |
| 2022/0299026 | A1 * | 9/2022 | Ding | F04C 2/025 |
| 2022/0299032 | A1 | 9/2022 | Lee et al. | |
| 2022/0316475 | A1 * | 10/2022 | Lee | F04C 29/128 |
| 2022/0389929 | A1 | 12/2022 | Lee et al. | |

FOREIGN PATENT DOCUMENTS

JP 5842637 B2 1/2016

* cited by examiner

*Primary Examiner* — Anthony Ayala Delgado
(74) *Attorney, Agent, or Firm* — Endurance Law Group PLC; James R. Yee

(57) ABSTRACT

An electric scroll compressor configured to compress a refrigerant for use with a vapor injection system, is provided. The compressor includes refrigerant inlet and outlet ports and a vapor injection port. The housing includes a valve plate having at least one vapor injection channel. A compression device includes a fixed scroll and an orbiting scroll. The orbiting scroll and the fixed scroll form compression chambers for receiving the refrigerant from the intake volume and compressing the refrigerant as the drive shaft is rotated about the center axis. The valve plate includes at least one vapor outlet aperture in communication with the at least one vapor injection channel for allowing vapor to enter a compression chamber formed between the fixed scroll and the orbiting scroll.

17 Claims, 9 Drawing Sheets

ELECTRIC COMPRESSOR WITH INTEGRATED VAPOR INJECTION CIRCUIT

FIELD OF THE INVENTION

The invention relates generally to electric compressor that compresses a refrigerant using a scroll compression device, and more particularly to an electric scroll compressor with an integrated vapor injection circuit.

BACKGROUND OF THE INVENTION

Compressors have long been used in cooling systems. In particular, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to provide air-conditioning. Such compressors may also be used, in reverse, in applications requiring a heat pump. Generally, these compressors are driven using rotary motion derived from the automobile's engine.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compartment of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade, the battery and/or other system. It may also be used to cooling the battery during times when the battery is not being charged or used, as heat may damage or degrade the battery. Since the electric compressor may be run at various times, even when the motor vehicle is not in operation, such use, may require electrical energy from the battery, thus reducing the operating time of the battery.

Some scroll compressors using vapor injection to increase the capacity if the compressor. In such systems, a portion of the compressed refrigerant from the output of the compressor may be controllably diverted through a vapor generator and sent back to the compressor under a higher temperature, pressure and/or vapor content and inserted back into the compression cycle. Generally, vapor injection results in higher efficiency and/or higher capacity of the compressor. However, most prior art compressors with vapor injection utilize an external assembly and/or additional components resulting in additional complexity and cost.

It is thus desirable, to provide an electric compressor having high efficiency, low-noise and maximum operating life. The present invention is aimed at one or more of the problems or advantages identified above.

BRIEF SUMMARY OF THE INVENTION

In a first aspect of the present invention, an assembly associated with an electric scroll compressor having a compression chamber is provided. The assembly includes a housing, a valve plate, and a vapor reed mechanism. The housing defines an intake volume, a discharge volume, and a vapor injection cavity. The housing includes a center housing, a rear head, a refrigerant inlet port, a refrigerant outlet port, and a vapor injection port. The rear head is coupled to the center housing. The refrigerant inlet port is coupled to the rear head and is configured to introduce refrigerant to the intake volume. The refrigerant outlet port is coupled to the rear head and is configured to allow compressed refrigerant to exit from the discharge volume. The vapor injection port is integral with the rear head and is coupled to the vapor injection cavity. The valve plate is adjacent the rear head and defines at least one plate groove. The at least one plate groove defines a vapor communication channel, a reed receiving portion, and an injection portion. The injection portion is fluidly coupled to the vapor injection cavity. The reed receiving portion is positioned between the vapor injection channel and the injection portion. The vapor injection channel has a first end and a second end. The first end of the vapor injection channel is adjacent the reed receiving portion. The vapor injection channel includes a vapor plate channel outlet aperture at the second end and is fluidly coupled to the compression chamber. The vapor reed mechanism is positioned within the reed receiving portion of the plate groove and is configured to control flow of vapor from the vapor injection cavity through the vapor communication channel and the vapor plate channel outlet aperture to the compression chamber.

In a second aspect of the present invention, an electric scroll compressor configured to compress a refrigerant for use with a vapor injection system is provided. The electric scroll compressor includes a housing, a refrigerant inlet port, a refrigerant outlet port, a vapor injection port, a compression device, a valve plate and a vapor reed mechanism. The housing has a center housing and a rear head and defines an intake volume, a discharge volume, and a vapor injection cavity. The refrigerant inlet port is coupled to the housing and is configured to introduce the refrigerant to the intake volume. The refrigerant outlet port is coupled to the housing and is configured to allow compressed refrigerant to exit the electric scroll compressor from the discharge volume. The vapor injection port is integral with the rear head and is coupled to the vapor injection cavity. The drive shaft is rotatably coupled inside the housing. The compression device is coupled to the drive shaft and is configured to receive the refrigerant from the intake volume and to compress as the drive shaft. The compression device includes a fixed scroll and an orbiting scroll. The fixed scroll is located within the housing and is fixed relative thereto. The orbiting scroll is coupled to the drive shaft. The orbiting scroll and the fixed scroll form a compression chamber for receiving the refrigerant from the intake volume and compressing the refrigerant as the drive shaft is rotated. The valve plate is adjacent the rear head and defines at least one plate groove. The at least one plate groove defines a vapor communication channel, a reed receiving portion, and an injection portion. The injection portion is fluidly coupled to the vapor injection cavity. The reed receiving portion is positioned between the vapor injection channel and the injection portion. The vapor injection channel has a first end and a second end. The first end of the vapor injection channel is adjacent the reed receiving portion. The vapor injection channel includes a vapor plate channel outlet aperture at the second end and is fluidly coupled to the compression chamber. The vapor reed mechanism is positioned within the reed receiving portion of the plate groove and is configured to control flow of vapor from the vapor injection cavity through the vapor communication channel and the vapor plate channel outlet aperture to the compression chamber.

In a third aspect of the present invention, an electric scroll compressor configured to compress a refrigerant for use with a vapor injection system is provided. The electric scroll compressor includes a housing, a refrigerant inlet port, a refrigerant outlet port, a vapor injection port, an inverter module, a motor, a compression device, a valve plate and a vapor reed mechanism. The housing has a center housing and a rear head and defines an intake volume, a discharge volume, and a vapor injection cavity. The refrigerant inlet port is coupled to the housing and is configured to introduce the refrigerant to the intake volume. The refrigerant outlet port is coupled to the housing and is configured to allow compressed refrigerant to exit the electric scroll compressor from the discharge volume. The vapor injection port is integral with the rear head and is coupled to the vapor injection cavity. The inverter module is mounted inside the housing and is adapted to convert direct current electrical power to alternating current electrical power. The motor is mounted inside the housing and is coupled to the inverter module. The drive shaft is coupled to the motor. The compression device is coupled to the drive shaft for receiving the refrigerant from the intake volume and compressing the refrigerant as the drive shaft is rotated by the motor. The compression device includes a fixed scroll located within the housing and being fixed thereto and an orbiting scroll coupled to the drive shaft. The orbiting scroll and the fixed scroll form a compression chamber for receiving the refrigerant from the intake volume and compressing the refrigerant as the drive shaft is rotated about the center axis. The valve plate is adjacent the rear head and defines at least one plate groove. The at least one plate groove defines a vapor communication channel, a reed receiving portion, and an injection portion. The injection portion is fluidly coupled to the vapor injection cavity. The reed receiving portion is positioned between the vapor injection channel and the injection portion. The vapor injection channel has a first end and a second end. The first end of the vapor injection channel is adjacent the reed receiving portion. The vapor injection channel includes a vapor plate channel outlet aperture at the second end and is fluidly coupled to the compression chamber. The vapor reed mechanism is positioned within the reed receiving portion of the plate groove and is configured to control flow of vapor from the vapor injection cavity and the vapor plate channel outlet aperture through the vapor communication channel to the compression chamber.

CLAUSES

1. An assembly associated with an electric scroll compressor having a compression chamber, comprising:

a housing defining an intake volume, a discharge volume, and a vapor injection cavity, the housing including:

a center housing;

a rear head coupled to the center housing;

a refrigerant inlet port coupled to the rear head and configured to introduce refrigerant to the intake volume;

a refrigerant outlet port coupled to the rear head and configured to allow compressed refrigerant to exit from the discharge volume; and, a vapor injection port integral with the rear head, the vapor injection port being coupled to the vapor injection cavity;

a valve plate adjacent the rear head and defining at least one plate groove, the at least one plate groove defining a vapor injection channel, a reed receiving portion, and an injection portion, the injection portion being fluidly coupled to the vapor injection cavity, the reed receiving portion positioned between the vapor injection channel and the injection portion, the vapor injection channel having a first end and a second end, the first end of the vapor injection channel being adjacent the reed receiving portion, the vapor injection channel including a vapor plate channel outlet aperture at the second end and being fluidly coupled to the compression chamber; and, a vapor reed mechanism positioned within the reed receiving portion of the plate groove and being configured to control flow of vapor from the vapor injection cavity through the vapor injection channel and the vapor plate channel outlet aperture to the compression chamber.

2. The assembly, as set forth in clause 1, wherein the rear head includes a rear head cavity, the rear head cavity being divided into the discharge volume and the vapor injection cavity by a series of partitions integral with the rear head.

3. The assembly, as set forth in clause 2, the series of partitions having a top surface adjacent the center housing.

4. The assembly, as set forth in clause 3, wherein the valve plate is positioned adjacent the top surface of the series of partitions.

5. The assembly, as set forth in clause 4, wherein the series of partitions divides the discharge volume into a plurality of discharge volumes including a central discharge volume, wherein the at least one plate groove includes first and second plate grooves formed within the valve plate on opposite sides of the central discharge volume.

6. The assembly, as set forth in clause 5, further including a gasket positioned between the center housing and the rear head and being configured to provide sealing between the discharge volume and the vapor injection cavity and the vapor injection channel of each of the first and second grooves.

7. An electric scroll compressor configured to compress a refrigerant for use with a vapor injection system, comprising:

a housing having a center housing and a rear head and defining an intake volume, a discharge volume, and a vapor injection cavity;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

a vapor injection port integral with the rear head and being coupled to the vapor injection cavity;

a drive shaft rotatably coupled inside the housing;

a compression device coupled to the drive shaft, configured to receive the refrigerant from the intake volume and to compress as the drive shaft, the compression device including:

a fixed scroll located within the housing and being fixed relative thereto; and, an orbiting scroll coupled to the drive shaft, the orbiting scroll and the fixed scroll forming a compression chamber for receiving the refrigerant from the intake volume and compressing the refrigerant as the drive shaft is rotated;

a valve plate adjacent the rear head and defining at least one plate groove, the at least one plate groove defining a vapor injection channel, a reed receiving portion, and an injection portion, the injection portion being fluidly coupled to the vapor injection cavity, the reed receiving portion positioned between the vapor injection channel and the injection portion, the vapor injection channel having a first end and a second end, the first end of the vapor injection channel being adjacent the reed receiving portion, the vapor injection channel including a vapor plate channel outlet aperture at the second end and being fluidly coupled to the compression chamber; and, a vapor reed mechanism positioned within the reed receiving portion of the plate groove and being configured to control flow of vapor from the vapor injection cavity through the vapor injection channel and the vapor plate channel outlet aperture to the compression chamber.

8. The electric scroll compressor, as set forth in clause 7, wherein the at least one plate groove includes first and second plate grooves formed within the valve plate.

9. The electric scroll compressor, as set forth in clause 7, wherein the rear head includes a rear head cavity, the rear head cavity being divided into the discharge volume and the vapor injection cavity by a series of partitions integral with the rear head.

10. The electric scroll compressor, as set forth in clause 8, the series of partitions having a top surface adjacent the center housing.

11. The electric scroll compressor, as set forth in clause 9, wherein the valve plate is positioned adjacent the top surface of the series of partitions between the rear head and the fixed scroll.

12. The electric scroll compressor, as set forth in clause 10, wherein the series of partitions divides the discharge volume into a plurality of discharge volumes including a central discharge volume, wherein the at least one plate groove includes first and second plate grooves formed within the valve plate on opposite sides of the central discharge volume.

13. The electric scroll compressor, as set forth in clause 11, further including a gasket positioned between the center housing and the rear head and being configured to provide sealing between the discharge volume and the vapor injection cavity and vapor injection channels.

14. An electric scroll compressor configured to compress a refrigerant for use with a vapor injection system, comprising:

a housing having a center housing and a rear head and defining an intake volume, a discharge volume, and a vapor injection cavity;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

a vapor injection port integral with the rear head and being coupled to the vapor injection cavity;

an inverter module mounted inside the housing and adapted to convert direct current electrical power to alternating current electrical power;

a motor mounted inside the housing and being coupled to the inverter module;

a drive shaft coupled to the motor; and, a compression device coupled to the drive shaft, for receiving the refrigerant from the intake volume and compressing the refrigerant as the drive shaft is rotated by the motor, the compression device including:

a fixed scroll located within the housing and being fixed thereto; and, an orbiting scroll coupled to the drive shaft, the orbiting scroll and the fixed scroll forming a compression chamber for receiving the refrigerant from the intake volume and compressing the refrigerant as the drive shaft is rotated about the center axis;

a valve plate adjacent the rear head and defining at least one plate groove, the at least one plate groove defining a vapor injection channel, a reed receiving portion, and an injection portion, the injection portion being fluidly coupled to the vapor injection cavity, the reed receiving portion positioned between the vapor injection channel and the injection portion, the vapor injection channel having a first end and a second end, the first end of the vapor injection channel being adjacent the reed receiving portion, the vapor injection channel including a vapor plate channel outlet aperture at the second end and being fluidly coupled to the compression chamber; and, a vapor reed mechanism positioned within the reed receiving portion of the plate groove and being configured to control flow of vapor from the vapor injection cavity through the vapor injection channel and the vapor plate channel outlet aperture to the compression chamber.

15. The electric scroll compressor, as set forth in clause 14, wherein the at least one plate groove includes first and second plate grooves.

16. The electric scroll compressor, as set forth in clause 14, wherein the rear head includes a rear head cavity, the rear head cavity being divided into the discharge volume and the vapor injection cavity by a series of partitions integral with the rear head.

17. The electric scroll compressor, as set forth in clause 16, the series of partitions having a top surface adjacent the center housing.

18. The electric scroll compressor, as set forth in clause 17, wherein the valve plate is positioned adjacent the top surface of the series of partitions between the rear head and the fixed scroll.

19. The electric scroll compressor, as set forth in clause 18, wherein the series of partitions divides the discharge volume into a plurality of discharge volumes including a central discharge volume, wherein the at least one plate groove includes first and second plate grooves formed within the valve plate on opposite sides of the central discharge volume.

20. The electric scroll compressor, as set forth in clause 19, further including a gasket positioned between the center housing and the rear head and being configured to provide sealing between the discharge volume and the vapor injection cavity and vapor injection channels.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

Referring to the FIGS. 1A-1B, 2A-2B, 3, 4A-4B, and 5-6, wherein like numerals indicate like or corresponding parts throughout the several views, an electric compressor 10 having an outer housing 12 is provided. The electric compressor 10 is particularly suitable in a motor vehicle, such as an automotive vehicle (not shown). The electric compressor 10 may be used as a cooling device or as a heating pump to heat and/or cool different aspects of the vehicle. For instance, the electric compressor 10 may be used as part of the heating, ventilation and air conditioning (HVAC) system 76 in electric vehicles (not shown) to cool or heat a passenger compartment. In addition, the electric compressor 10 may be used to heat or cool the passenger compartment, on-board electronics and/or a battery used for powering the vehicle while the vehicle is not being operated, for instance, during a charging cycle. The electric compressor 10 may further be used while the vehicle is not being operated and while the battery is not being charged to maintain, or minimize the degradation, of the life of the battery.

Figure 1A:
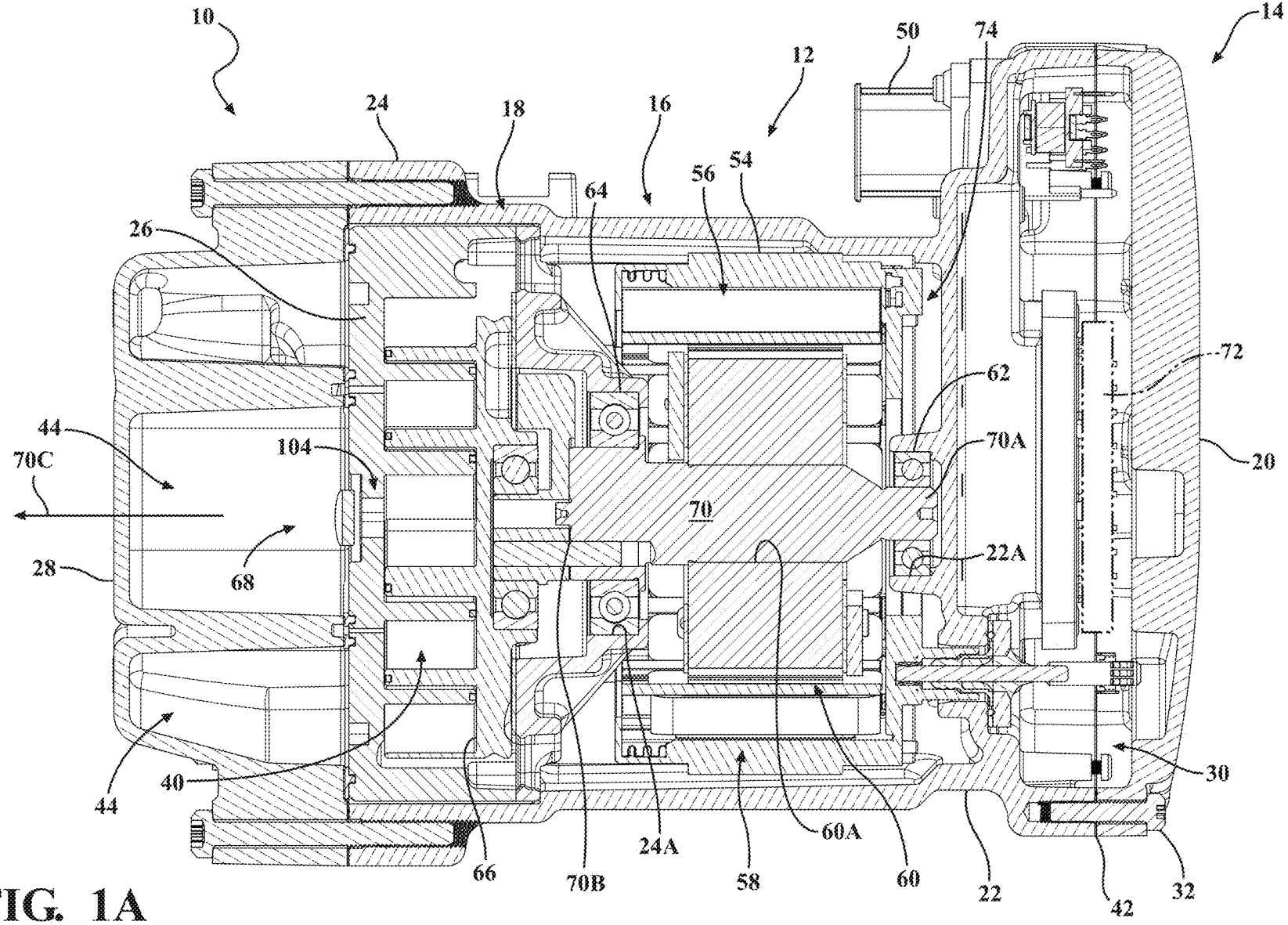
FIG. 1A is a cross-sectional view of an electric compressor according to an embodiment of the present invention.
Figure 1B:
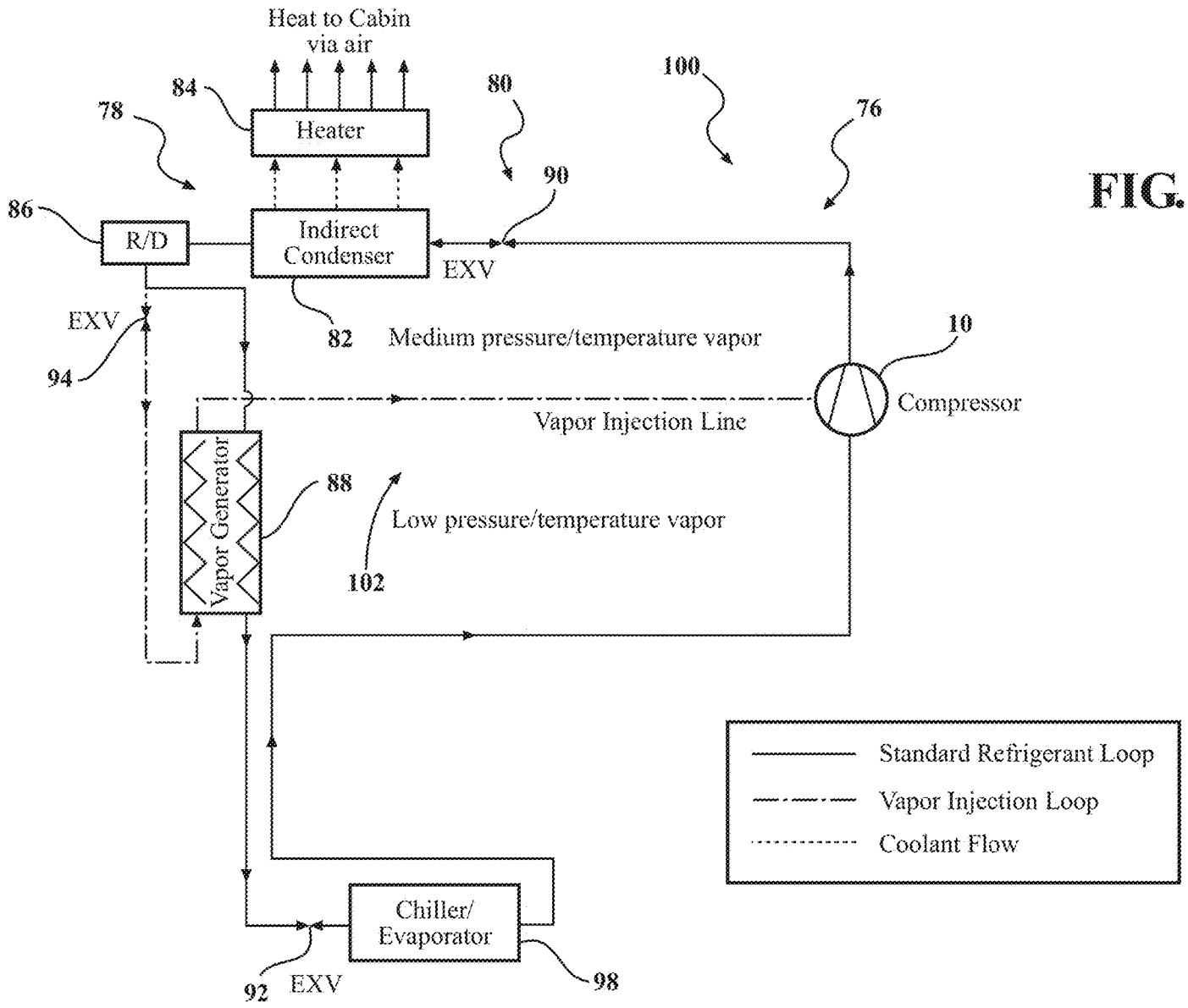
FIG. 1B is a functional block diagram of a system including an electric compressor using vapor injection.

As discussed in more detail below with specific reference to FIG. 1B, the HVAC system 76 may configured to provide heat to an interior space, such as a cabin of the automotive vehicle (not shown). As shown, the HVAC system 76 includes or defines a heating circuit 78.

In the illustrated embodiment, the electric compressor 10 is a scroll-type compressor acts to compress a refrigerant rapidly and efficiently for use in different systems of a motor vehicle, for example, an electric or a hybrid vehicle. With specific reference to FIG. 1A, the electric compressor 10 includes an inverter section 14, a motor section 16, and a compression device (or compression assembly) 18 contained within the outer housing 12. The outer housing 12 includes an inverter back cover 20, an inverter housing 22 and a center housing 24 (which may be integral), a rear head 28 (which may be referred to as the discharge head). The center housing 24 houses the motor section 16 and the compression device 18.

In one embodiment, the inverter back cover 20, the inverter housing 22, the center housing 24, and the rear head 28 are composed from machined aluminum. The electric compressor 10 may be mounted, for example, within the body of a motor vehicle, via a plurality of mount points (not shown).

In one aspect of the electric compressor 10 of the disclosure, an electric compressor 10 having a vapor system 100 (see below) is provided to increase the efficiency of the compressor 10. Further, as discussed below, the vapor system 100 may include a vapor injection circuit 102.

General Arrangement, and Operation, of the Electric Compressor 10

The inverter back cover 20 and the inverter housing 22 form an inverter cavity 30. The inverter back cover 20 is mounted to the inverter housing 22 by a plurality of bolts 32. An inverter gasket 42, positioned between the inverter back cover 20 and the inverter housing 22 keeps moisture, dust, and other contaminants from the inverter cavity 30.

An inverter module 72 mounted within the inverter cavity 30 formed by the inverter back cover 20 and the inverter housing 22. The inverter module 72 may include an inverter circuit (not shown) mounted on a printed circuit board (not shown), which is mounted to the inverter housing 22. The inverter circuit converts direct current (DC) electrical power received from outside of the electric compressor 10 into three-phase alternating current (AC) power to supply/power a motor 54 (see below). The inverter circuit may also control the rotational speed of the electric compressor 10. High voltage DC current is supplied to the inverter circuit via a high voltage connector 50. Low voltage DC current to drive the inverter circuit, as well as control signals to control operation of the inverter circuit, and the motor section 16, may be supplied via a low voltage connecter 52.

The center housing 24 forms a motor cavity 56. The motor section 16 includes a motor 54 located within the motor cavity 56. With specific reference to FIG. 12, in the illustrated embodiment, the motor 54 is a three-phase AC motor having a stator 56. The stator 56 has a generally hollow cylindrical shape with six individual coils (two for each phase). The stator 56 is contained within, and mounted to, the motor housing 22 and remains stationery relative to the motor housing 22.

The motor 54 includes a rotor 60 located within, and centered relative to, the stator 58. The rotor 60 has a generally hollow cylindrical shape and is located within the stator 56.

A drive shaft 70 is coupled to the rotor 60 and rotates therewith. In the illustrated embodiment, the draft shaft 90 is press-fit within a center aperture 60A of the rotor 60. The drive shaft 70 has a first end 70A and a second end 70B. The inverter housing 22 includes a first drive shaft supporting member 22A located on the motor side of the inverter housing 22. A first ball bearing 62 located within an aperture formed by the first drive shaft supporting member 22A supports and allows the first end of the drive shaft 70 to rotate. The center housing 24 includes a second drive shaft supporting member 24A. A second ball bearing 64 located within an aperture formed by the second drive shaft supporting member 24A allows the second end 70B of the drive shaft 70 to rotate. In the illustrated embodiment, the first and second ball bearing 62, 64 are press-fit with the apertures formed by the first drive shaft supporting member 22 of the inverter housing 22 and the second drive shaft supporting member 24A of the center housing 24, respectively.

As stated above, the electric compressor 10 is a scroll-type compressor. The compression device 18 includes the fixed scroll 26 and an orbiting scroll 66. The orbiting scroll 66 is fixed to the second end 70B of the drive shaft 70. The rotor 60 with the drive shaft 70 rotate to drive the orbiting scroll 66 motion under control of the inverter module 72.

The drive shaft 70 has a central axis 70C around which the rotor 60 and the drive shaft 70 are rotated. The orbiting scroll 66 moves about the central axis 70C in an eccentric orbit, i.e., in a circular motion while the orientation of the orbiting scroll 66 remains constant with respect to the fixed scroll 26. The center of the orbiting scroll 66 is located along an offset axis (not shown) of the drive shaft 70.

Generally, intermixed refrigerant and oil (at low pressure) enters the electric compressor 10 via a refrigerant inlet port 34 (see for example, FIG. 2A) and exits the electric compressor 10 (at high pressure) via refrigerant outlet port 36 after being compressed by the compression device 18. Refrigerant follows a refrigerant path through the electric compressor 10. Refrigerant enters the refrigerant inlet port and enters an intake volume 74 formed between the motor side of the inverter housing 22 and the center housing 24 adjacent the refrigerant inlet port. Refrigerant is then drawn through the motor section 16 and enters a compression intake volume formed between an internal wall of the fixed scroll 26 and the orbiting scroll 66.

The fixed scroll 26 is mounted within the center housing 24. Refrigerant enters the compression device 18 from the compression intake volume. The fixed scroll 26 and the orbiting scroll 66 form compression chambers 40 in which low or unpressurized (saturation pressure) refrigerant enters from the compression device 18. As the orbiting scroll 66 moves to enable the compression chambers 40 to be closed off and the volume of the compression chambers is reduced to pressurize the refrigerant. At any one time during the cycle, one or more compression chambers 40 are at different stages in the compression cycle. During a cycle of the compressor 10, the refrigerant is transported towards the center of the compression chambers 40.

Returning to FIG. 1A, the rear head 28 forms a discharge volume 44. The discharge volume 44 is in communication with the refrigerant output port 36. Pressurized refrigerant leaves the compression device 18 through one or more orifices 104 (see FIG. 4A). The release of pressurized refrigerant is controlled by a reed mechanism 68.

Returning to FIG. 1A, compressed refrigerant exits the electric compressor 10 into the heating circuit 78. The heating circuit 78 includes a main refrigerant loop 80 and a vapor system 100.

The main refrigerant loop 80 includes an indirect condenser 82, a receiver-dryer (R/D) 86, and a vapor generator 88. A first expansion valve 90 controls the amount of refrigerant that enters the indirect condenser 82. Refrigerant enters the indirect condenser 82 in which heat is exchanged with a coolant flowing to/from a heater 84 located within or associated with the cabin of the automotive vehicle (as is known).

Refrigerant exits the indirect condenser 82 and may enter a receiver/dryer (R/D) 86. The R/D 86 may act as a temporary storage container during low system demand and may include a desiccant for removing moisture from the moisture/water.

As part of the main refrigerant loop 80 refrigerant may exit the R/D 82 and pass through the vapor generator 88. From the vapor generator 88, refrigerant passes through an evaporator or chiller 98 before returning at low temperature and pressure to the electric compressor 10. A second expansion valve 92 controls the flow of fluid from the vapor generator 88 to the evaporator/chiller 98.

Vapor System

Returning to FIG. 1B and FIGS. 2A-2B, 3, 4A-4E, and 5-6, in one aspect of the present invention, in the illustrated embodiment the heating circuit 78 includes the vapor system 100. In the illustrated embodiment, the vapor system 100 includes a vapor injection circuit 102.

Returning to FIG. 1B, the vapor injection circuit 102 is at least partially formed by the vapor generator 88. As shown in the illustrated embodiment, the refrigerant out of the R/D 86 may be split. As described above, a portion of the flow out of the R/D 86 is part of the main refrigerant loop 80 and flows through the vapor generator 88 and the evaporator/chiller 98 and back to the electric compressor 10.

A second portion of the flow out of the R/D 86 flows through (a different part of) the vapor generator and back to the electric compressor 10. The second portion of the flow out of the R/D 86 is controlled by a third expansion valve 94. The refrigerant in the second portion of the flow out of the R/D 86 exits the vapor generator 88 at a higher temperature and pressure and/or vapor percentage as a result of heat transfer. This portion of the refrigerant is fed back into the electric compressor at a vapor injection port 38 of the electric compressor 10 (see below).

In one aspect of the present invention, the compressor 10 includes several components (or assembly 101) configured to interface with the vapor injection circuit 102 and are contained within and/or integrally formed with other components of the compressor 10. In one aspect of the present invention, components of the vapor injection system 100 may be integrated within the compressor 10, specifically, in the illustrated embodiment, with the rear head 28. An exemplary compressor 10 including integral components of the vapor injection system 100 is shown in FIGS. 2A-2B, 3, 4A-4E, and 5-6.

Figure 3:
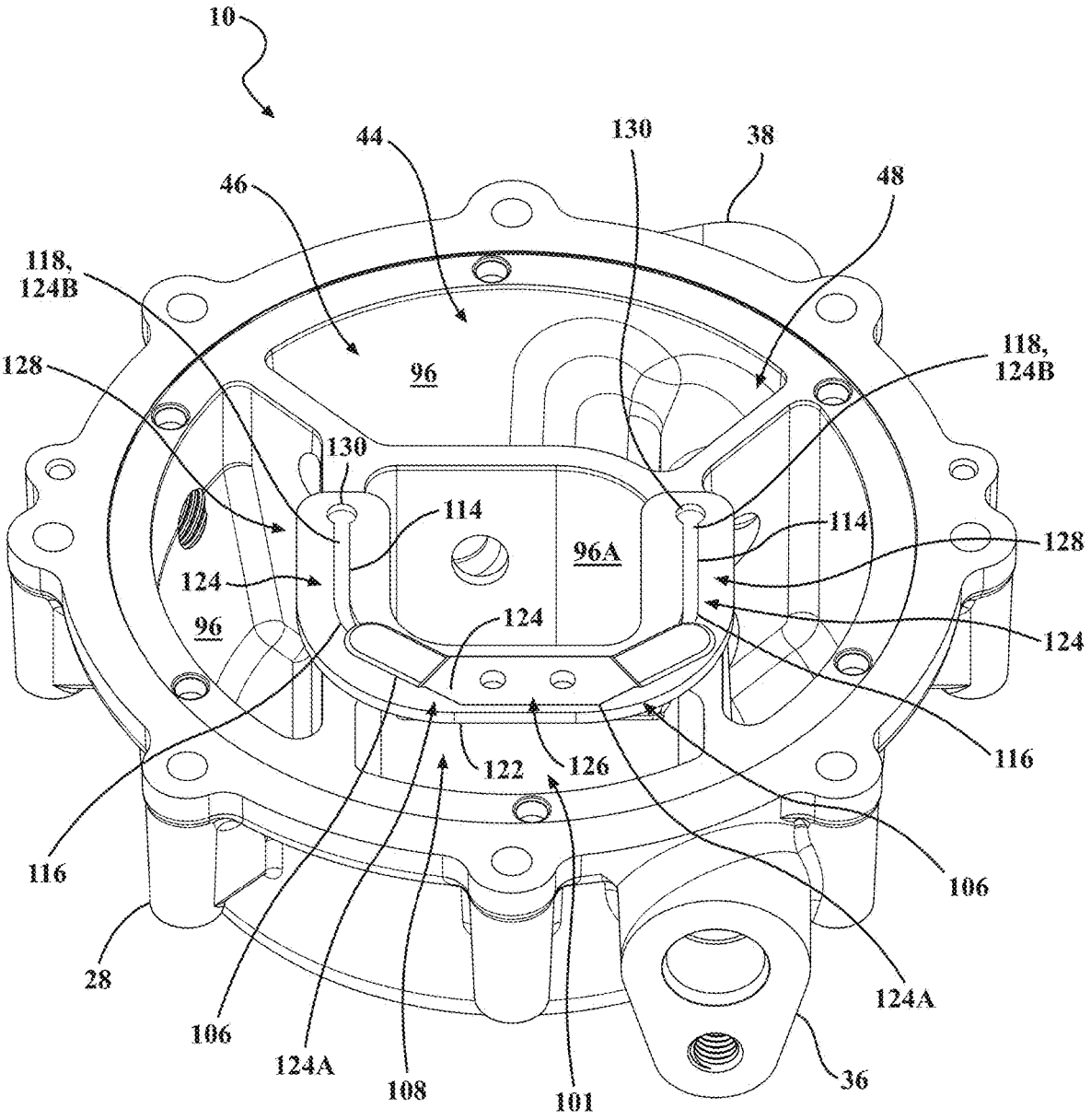
FIG. 3 is a view of a portion the electric compressor of FIG. 2A.

As discussed above, the electric compressor 10 includes a housing or outer housing 12. In the illustrated embodiment, the outer housing 12 is comprised of the center housing 24, the inverter back cover 20, and the rear head 28. With particular reference to FIG. 1A, the outer housing 12 defines, at least in part, the intake volume 74, the discharge volume 44, and a vapor injection cavity 108. As shown in FIG. 3, the electric compressor 10 may include a vapor plate 122.

As shown in FIGS. 3, 4B, and 5-6, the vapor plate 122 may include a plate groove 124. Each groove 124 defines a vapor communication channel 114, a reed receiving portion 126, and an injection portion 128. The injection portion 128 is fluidly coupled to the vapor injection cavity 108. The reed receiving portion 126 is positioned between the vapor injection channel 114 and the injection portion 128.

In the illustrated embodiment, the vapor injection channel 114 has a first end 114A and a second end 114B. The first end 114A of the vapor injection channel 114 is adjacent the reed receiving portion 126B. The vapor injection channel 114 includes a vapor plate channel outlet aperture 130 at the second end 114B and is fluidly coupled to the compression chamber 40.

Figure 2A:
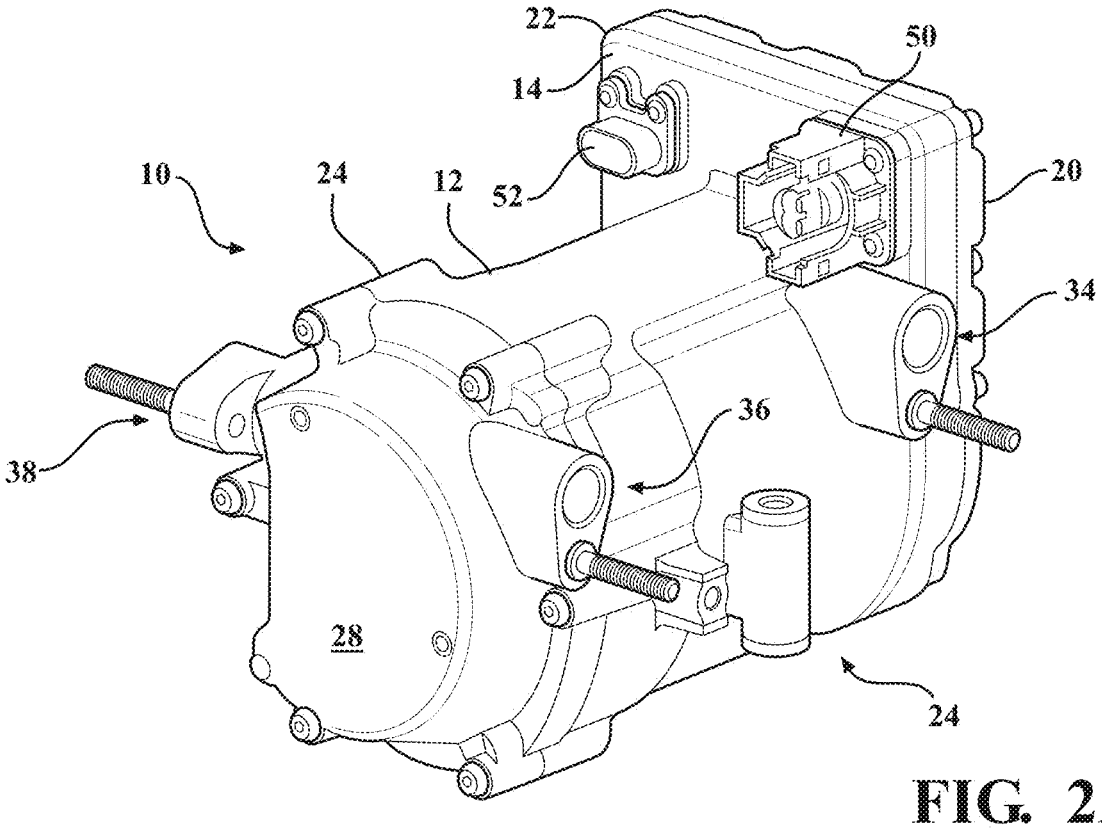
FIG. 2A is a first perspective view of an electric compressor utilizing vapor injection according to an embodiment of the present invention.
Figure 2B:
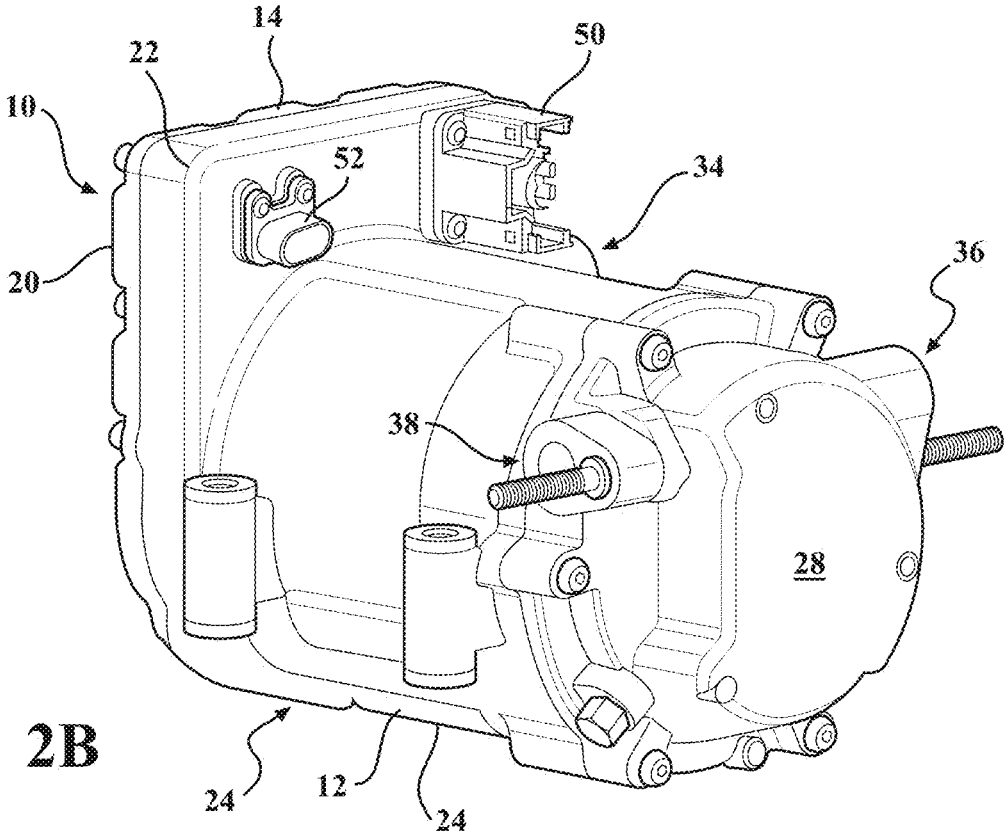
FIG. 2B is a second perspective view of the electric compressor of FIG. 2A.

With particular reference to FIGS. 2A, 2B, and 3, the electric scroll compressor 10 further includes a refrigerant inlet port 34, a refrigerant outlet port 36, and a vapor injection port 38. The refrigerant inlet port 34 is coupled to the housing 12, and in the illustrated embodiment, is connected to the center housing 24. The refrigerant inlet port 34 is configured to introduce the refrigerant to the intake volume 74. The refrigerant outlet port 36 is coupled to the housing 12, and in the illustrated embodiment, is coupled to the rear head 28. The refrigerant outlet port 36 is configured to allow compressed refrigerant to exit the electric scroll compressor 10 from the discharge volume 44.

The reed receiving portion 126 is configured to receive the vapor reed mechanism 106. Generally, vapor from the vapor injection circuit 102 enters the vapor injection cavity 108 of the electric compressor 10 and the injection portion 128 of the plate groove 124 in the vapor plate 122. The vapor reed mechanism 106 controllably allows vapor to enter the compression chamber 40 formed by the compression device 18 through the vapor injection channel 114 the vapor plate channel outlet aperture 130.

In the illustrated embodiment, the vapor injection port 38 is integral with the rear head 28 and is coupled to, i.e., in fluidic communication with, the vapor injection cavity 108.

As discussed above, in the illustrated embodiment the inverter module 72 is configured to convert direct current electrical power (provided externally) to alternating current electrical power to drive the motor 54. In the illustrated embodiment, the inverter module 72 and the motor 54 are located within the housing 12. However, in other embodiments, the inverter module 72 or the inverter module 72 and the motor 54 may be located external to the housing 12 or compressor 10.

The motor 54 controllably rotates the drive shaft 70. The compression device 18 is coupled to the drive shaft 70 and driven thereby. The compression device 18. The compression device 70 is configured to receive the refrigerant from the intake volume and compressing the refrigerant as the drive shaft 70 is rotated by the motor 54.

In the illustrated embodiment, the compression device 18 includes the fixed scroll 26 and the orbiting scroll 66. The fixed scroll 26 is located within, and fixed to, the housing 12. The orbiting scroll 66 is coupled to the drive shaft 70. The orbiting scroll 66 and the fixed scroll 26 form the compression chamber(s) 40 for receiving the refrigerant from the intake volume 74 and for compressing the refrigerant as the drive shaft 70 is rotated about the center axis 70C.

Figure 4A:
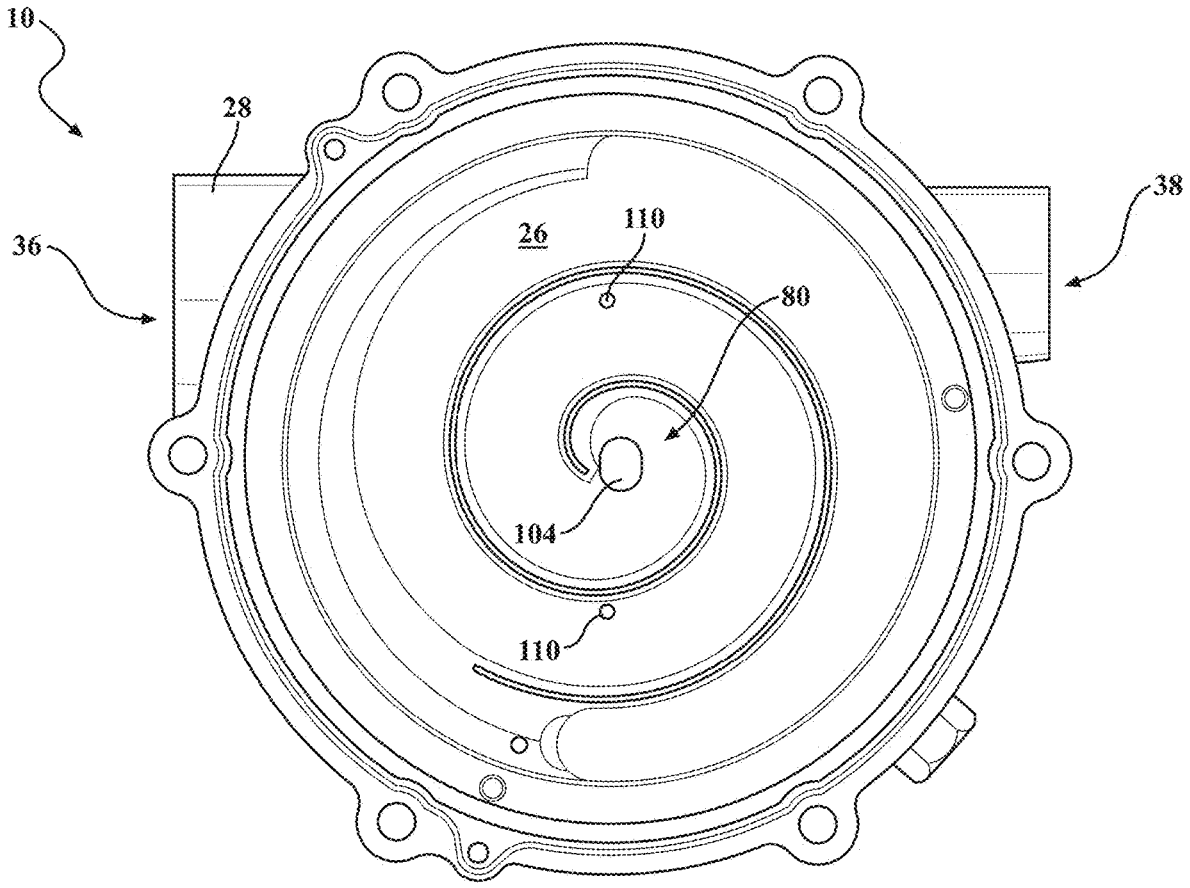
FIG. 4A is a front view of a fixed scroll of the electric compressor of FIG. 2A.

With particular reference to FIGS. 4A, the fixed scroll 26 includes at least one vapor outlet aperture 110 in communication with the at least one vapor injection channel 114 for allowing vapor to enter the compression chamber 40 formed between the fixed scroll 26 and the orbiting scroll 66.

Figure 4B:
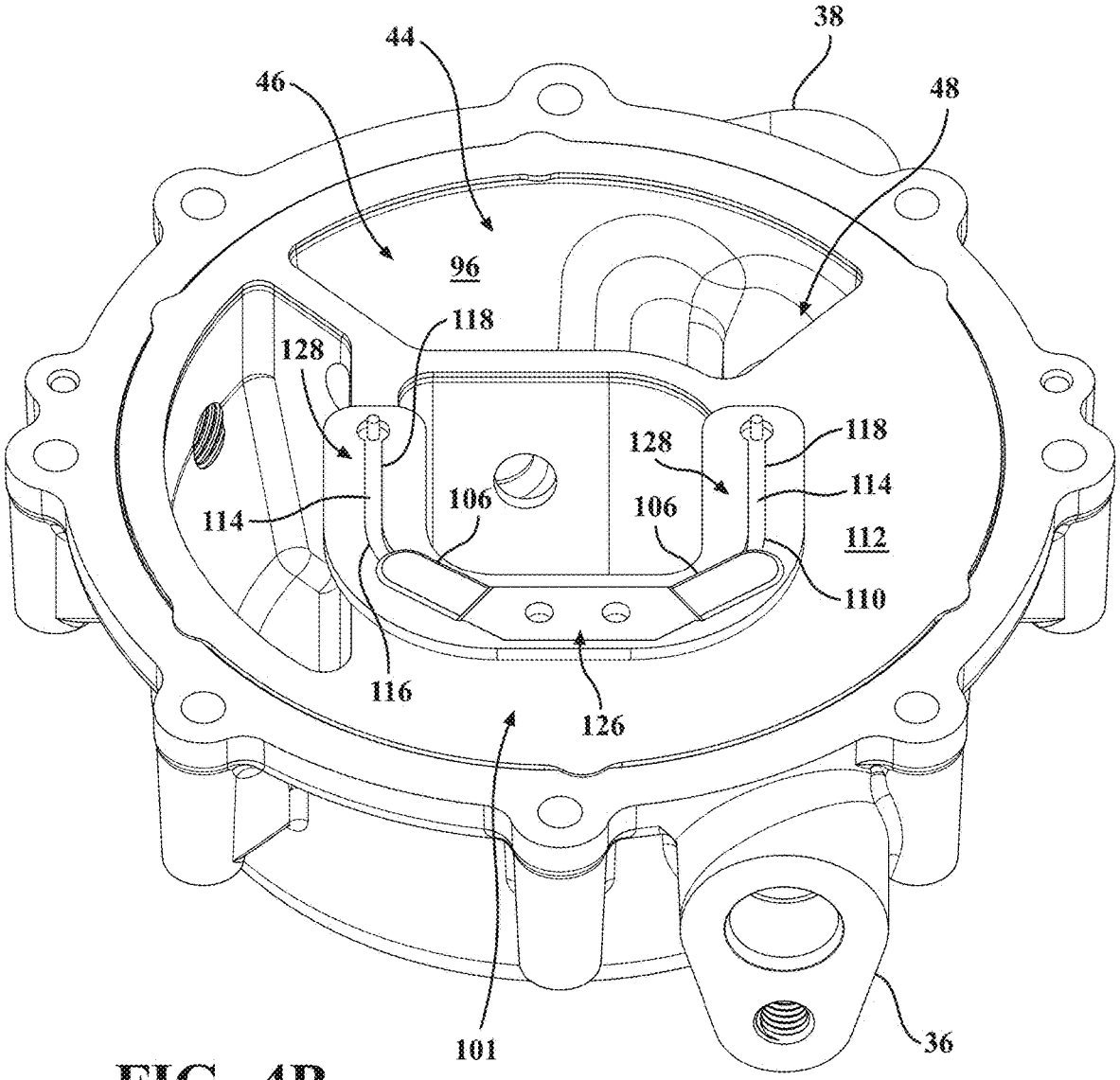
FIG. 4B is a first perspective view of a rear head of the electric compressor of FIG. 2A.
Figure 5:
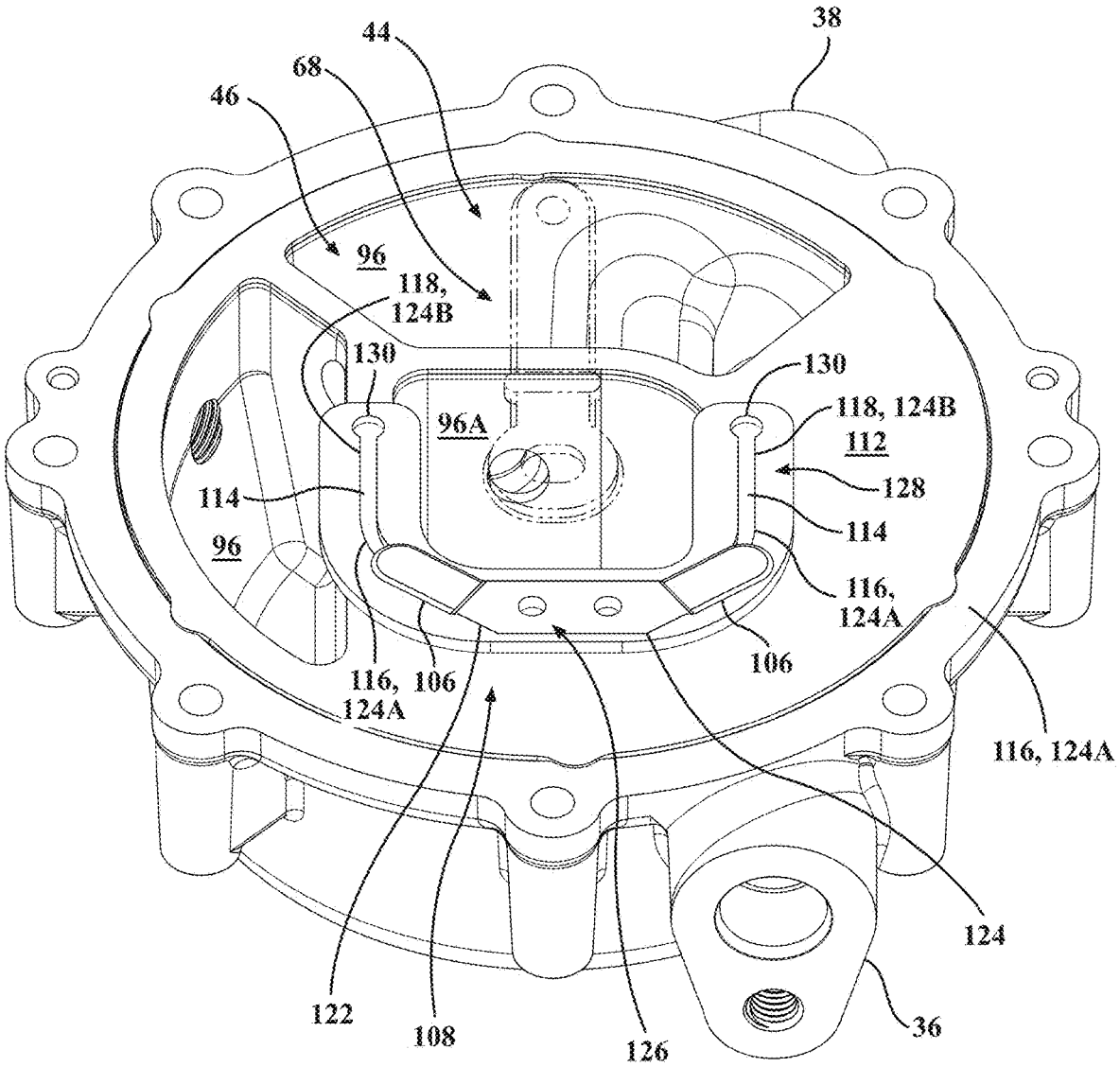
FIG. 5 is a second perspective view of the front cover of FIG. 4B.
Figure 6:
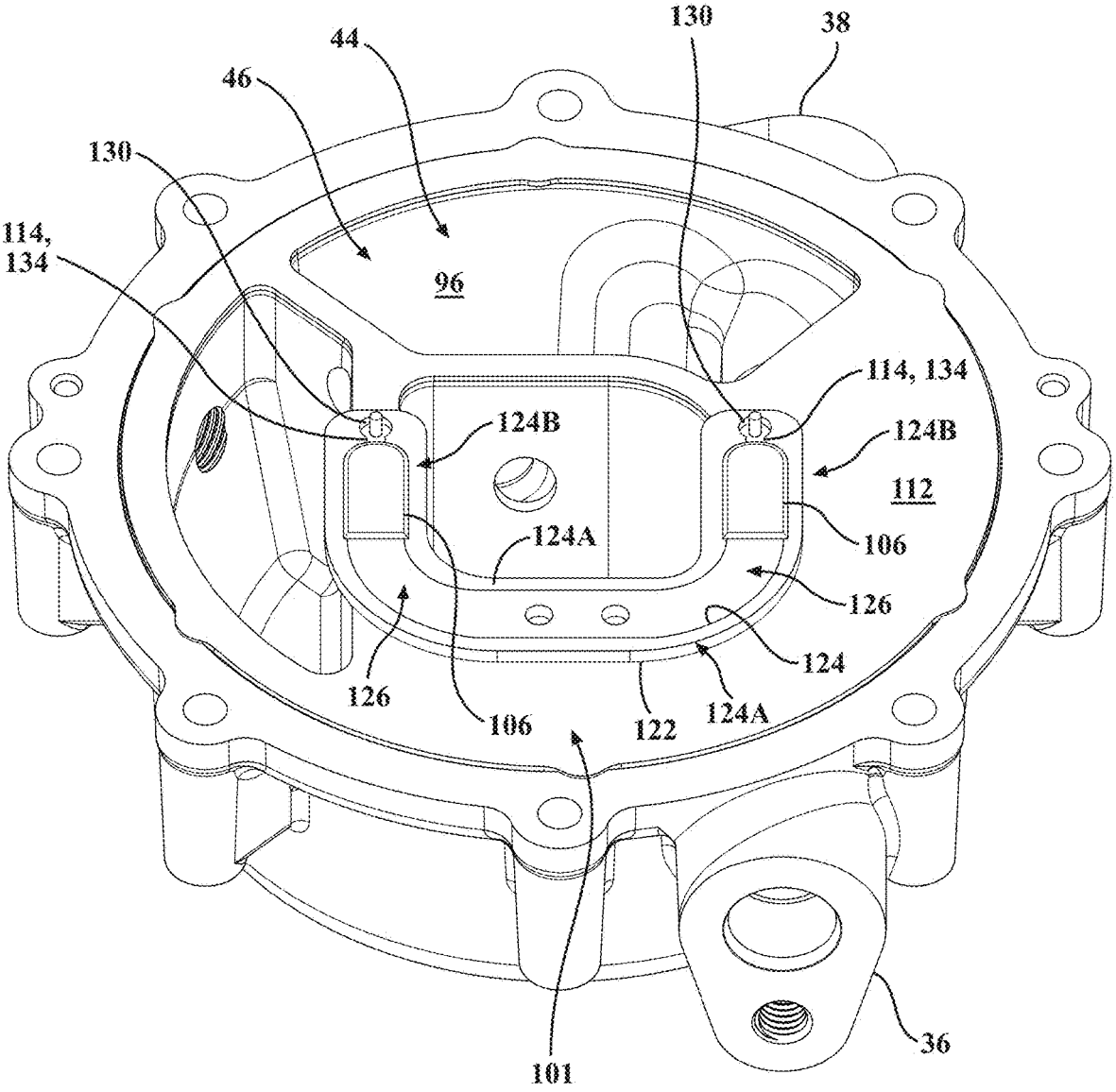
FIG. 6 is a perspective view of a rear head of the electric compressor of FIG. 2A, according to another embodiment of the present invention.

With particular reference to FIGS. 4B, 5 and 6, in the illustrated embodiment, the rear hard 28 includes a rear head (or interior) cavity 46 and a series of partitions 48. The series of partitions 48 divides the read head cavity 46 into the discharge volume 44 and the vapor injection cavity 108.

The discharge volume 44 may be further divided into sub-chambers 96 that form an oil separator that is integral to the rear head 28. Oil may be used to provide lubrication between the moving components of the electric compressor 10. During operation, the oil and the refrigerant become mixed. The oil separator may be used to separate some of the oil from the mixture of the oil and refrigerant before the refrigerant leaves the electric compressor 10.

As shown in FIGS. 5 and 6, the sub-chambers 96 of the discharge volume 44 may include a central sub-chamber 96A. As shown, the compressed refrigerant enters the central sub-chamber 96A from the compression chamber 40 via the orifice 104 in the fixed scroll 26 and the reed mechanism 68.

As shown, the vapor plate 122 may be located between the rear head 28 and the fixed scroll 26. In the illustrated embodiment, the vapor plate 122 may be generally u-shaped with first and second plate grooves 124 extending from the vapor injection cavity 108 along opposite sides of the central sub-chamber 96A. Each of the first and second plate grooves 124 has a respective vapor injection channel 122, reed received portion 126, and injection portion 118.

In the illustrated embodiment, the first and second plate grooves 124 has a first end 124A and a second end 124B. The first end 124A of each plate groove 124 is fluidly fluidly connected to the vapor injection cavity 108. The plate grooves 124 extend away from the vapor injection cavity 108 towards the second end 124B. As shown, in the illustrated embodiment, the plate grooves 124 follow along opposite ends of the vapor plate 122 which follow along opposite partitions 48 forming the central sub-chamber 96A.

With particular reference to FIGS. 3, 4B, and 5-7, the electric scroll compressor 10 may further include a vapor reed mechanism 106 positioned within each reed receiving portion 126 of the first and second plate grooves 124. The vapor reed mechanism 106 is positioned is configured to control flow of vapor from the vapor injection cavity 108 through respective plate groove 124 and the respective vapor injection channel 114. The characteristics of the vapor reed mechanism 106, such as material and strength, are selected to control the pressure at which the vapor is allowed to enter the vapor injection cavity 108 from the vapor injection port 38. The vapor reed mechanism 106 forms a valve that controllably allows vapor into the compression chambers 40 and prevents backflow of vapor back into the vapor injection cavity 108. In the illustrated embodiment, the vapor reed mechanism 106 is retained in place by the reed receiving portion 126 of the plate groove 124 and the fixed scroll 26.

Under control of the third expansion valve 94 vapor (from the enter the compressor 10 via the vapor injection port 38 and enters the vapor injection cavity 108 and the vapor injection channels 114.

When assembled, the rear head 28 is adjacent the fixed scroll 26. The second ends 118 of the vapor injection channels 114 are adjacent to the vapor outlet apertures 110 in the fixed scroll 26. The vapor plate channel outlet apertures 130 at the second end 118 of each vapor injection channel 114 is aligned with the vapor outlet apertures 110 in the fixed scroll 26. This arrangement allows vapor from the vapor injection circuit 102, when passed by the vapor reed mechanisms 106, to travel from the vapor injection cavity 108 through the vapor injection channels 114 and to pass into the compression chamber 40 through the vapor outlet apertures 110 in the fixed scroll 26.

Figure 4C:
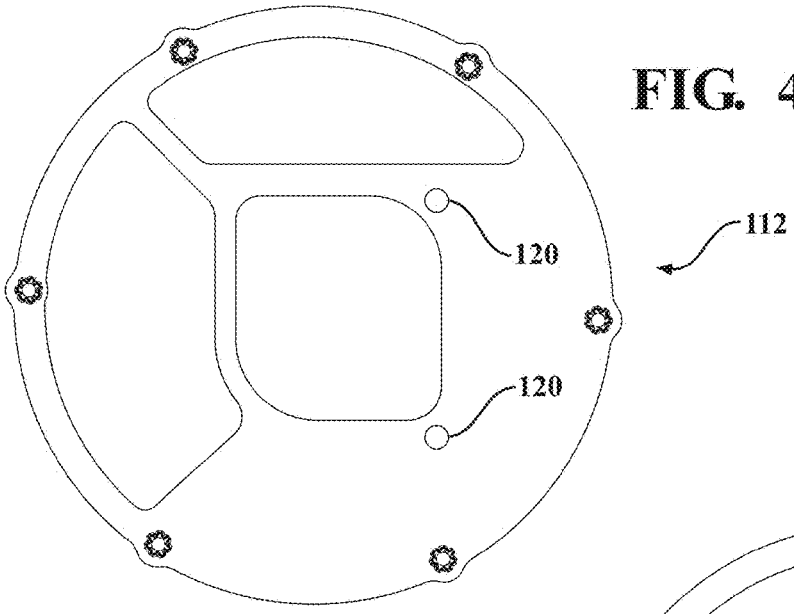
FIG. 4C is a front view of a gasket of the electric compressor of FIG. 2A, according to an embodiment of the present invention.
Figure 4D:
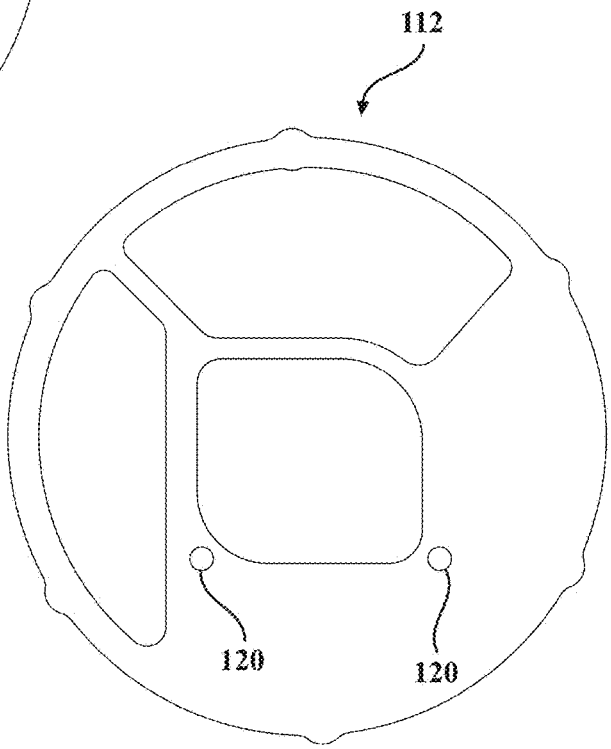
FIG. 4D is a rear view of the gasket of FIG. 4C.
Figure 4E:
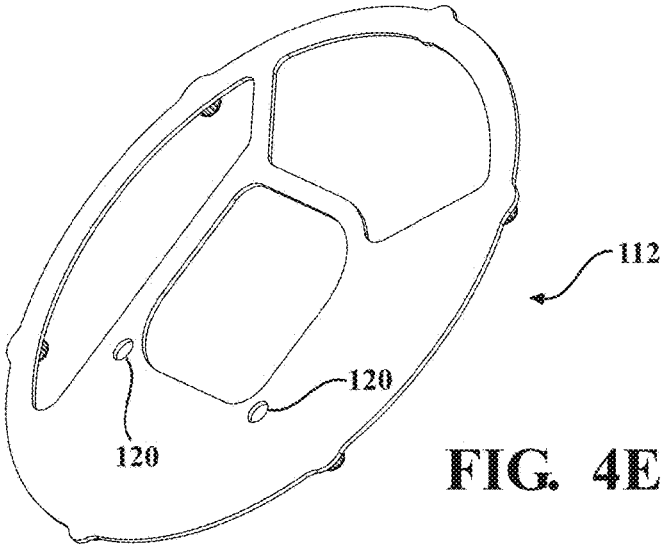
FIG. 4E is a perspective view of the gasket of FIG. 4C.

With reference to FIGS. 4C-4E, a gasket 112 may be positioned between the center housing 24 (and the fixed scroll 26) and the rear head 28. The gasket 112 is located within the interface between, the rear head 28 and the fixed scroll 26 and provides pressure separation between the high pressure in the discharge volume 66 and the vapor injection cavity 108. The gasket 112 may be configured to provide sealing between the discharge volume 44 (and sub-chambers 96) and the vapor injection cavity 108 and vapor injection channels 114. As shown, the gasket 112 may provide a number of apertures 120 located adjacent the second end 118 of the vapor injection channels 114 and the vapor outlet apertures 110 in the fixed scroll 26 to allow vapor to pass therethrough.

In the illustrated embodiment, the compressor 10 includes the vapor reed mechanism(s) 106, a vapor injection cavity 108 and one or more vapor injection channels 114. In the illustrated embodiment, the fixed scroll 26 is adjacent the rear head 28. As shown, the rear head 28 forms the discharge volume 66 (which may be comprised of a plurality of chambers configured to separate oil from the refrigerant prior to discharge from the compressor 10). In the illustrated embodiment, the vapor injection cavity 108 are formed by, and integral with the rear head 28. However, it should be noted that the vapor injection cavity 108 may be formed, at least in part by the fixed scroll 26.

In the illustrated embodiment, the vapor injection channel(s) 114 are formed within vapor plate 122. The vapor injection cavity 108 is in fluid communication with the vapor injection port 38. The third expansion valve 94 which is external to the compressor 10 controls the flow of vapor to the vapor injection port 38.

The geometry of the vapor plate 122, and in particular the plate grooves 124 and vapor injection channels 114 may affect the pumping efficiency of the electric compressor 10. The injection channel 114 along with the vapor outlet apertures 110 in the fixed scroll 26 and the vapor plate channel outlet aperture(s) 130 define a dead/back flow volume 132. The inclusion of the vapor plate(s) 122 which define the vapor injection channel(s) 114 allow the dead/back flow volume(s) 132 to be tuned or modified to a specific application of the electric compressor 10 without requiring modification of the rear head 28. A rear head 28 and vapor plate 122 according to a second embodiment of the present invention, with different dead/back flow volumes is shown in FIG. 6.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed:

1. An assembly associated with an electric scroll compressor having a compression chamber, comprising:

a housing defining an intake volume, a discharge volume, and a vapor injection cavity, the housing including:

a center housing;

a rear head coupled to the center housing;

a refrigerant inlet port coupled to the rear head and configured to introduce refrigerant to the intake volume;

a refrigerant outlet port coupled to the rear head and configured to allow compressed refrigerant to exit from the discharge volume; and, a vapor injection port integral with the rear head, the vapor injection port being coupled to the vapor injection cavity;

a valve plate adjacent the rear head and defining at least one plate groove, the at least one plate groove defining a vapor injection channel, a reed receiving portion, and an injection portion, the injection portion being fluidly coupled to the vapor injection cavity, the reed receiving portion positioned between the vapor injection channel and the injection portion, the vapor injection channel having a first end and a second end, the first end of the vapor injection channel being adjacent the reed receiving portion, the vapor injection channel including a vapor plate channel outlet aperture at the second end and being fluidly coupled to the compression chamber; and, a vapor reed mechanism positioned within the reed receiving portion of the plate groove and being configured to control flow of vapor from the vapor injection cavity through the vapor injection channel and the vapor plate channel outlet aperture to the compression chamber, wherein the rear head includes a rear head cavity, the rear head cavity being divided into the discharge volume and the vapor injection cavity by a series of partitions integral with the rear head.

2. The assembly, as set forth in claim 1, the series of partitions having a top surface adjacent the center housing.

3. The assembly, as set forth in claim 2, wherein the valve plate is positioned adjacent the top surface of the series of partitions.

4. The assembly, as set forth in claim 3, wherein the series of partitions divides the discharge volume into a plurality of sub-chambers including a central sub-chamber, wherein the at least one plate groove includes first and second plate grooves formed within the valve plate on opposite sides of the central sub-charge.

5. The assembly, as set forth in claim 4, further including a gasket positioned between the center housing and the rear head and being configured to provide sealing between the sub-chamber and the vapor injection cavity and the vapor injection channel of each of the first and second grooves.

6. An electric scroll compressor configured to compress a refrigerant for use with a vapor injection system, comprising:

a housing having a center housing and a rear head and defining an intake volume, a discharge volume, and a vapor injection cavity;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

a vapor injection port integral with the rear head and being coupled to the vapor injection cavity;

a drive shaft rotatably coupled inside the housing;

a compression device coupled to the drive shaft, configured to receive the refrigerant from the intake volume and to compress as the drive shaft, the compression device including:

a fixed scroll located within the housing and being fixed relative thereto; and, an orbiting scroll coupled to the drive shaft, the orbiting scroll and the fixed scroll forming a compression chamber for receiving the refrigerant from the intake volume and compressing the refrigerant as the drive shaft is rotated;

a valve plate adjacent the rear head and defining at least one plate groove, the at least one plate groove defining a vapor injection channel, a reed receiving portion, and an injection portion, the injection portion being fluidly coupled to the vapor injection cavity, the reed receiving portion positioned between the vapor injection channel and the injection portion, the vapor injection channel having a first end and a second end, the first end of the vapor injection channel being adjacent the reed receiving portion, the vapor injection channel including a vapor plate channel outlet aperture at the second end and being fluidly coupled to the compression chamber; and, a vapor reed mechanism positioned within the reed receiving portion of the plate groove and being configured to control flow of vapor from the vapor injection cavity through the vapor injection channel and the vapor plate channel outlet aperture to the compression chamber, wherein the rear head includes a rear head cavity, the rear head cavity being divided into the discharge volume and the vapor injection cavity by a series of partitions integral with the rear head.

7. The electric scroll compressor, as set forth in claim 6, wherein the at least one plate groove includes first and second plate grooves formed within the valve plate.

8. The electric scroll compressor, as set forth in claim 7, the series of partitions having a top surface adjacent the center housing.

9. The electric scroll compressor, as set forth in claim 6, wherein the valve plate is positioned adjacent the top surface of the series of partitions between the rear head and the fixed scroll.

10. The electric scroll compressor, as set forth in claim 8, wherein the series of partitions divides the discharge volume into a plurality of sub-chambers including a central sub-chamber, wherein the at least one plate groove includes first and second plate grooves formed within the valve plate on opposite sides of the central sub-chamber.

11. The electric scroll compressor, as set forth in claim 9, further including a gasket positioned between the center housing and the rear head and being configured to provide sealing between the discharge volume and the vapor injection cavity and vapor injection channels.

12. An electric scroll compressor configured to compress a refrigerant for use with a vapor injection system, comprising:

a housing having a center housing and a rear head and defining an intake volume, a discharge volume, and a vapor injection cavity;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

a vapor injection port integral with the rear head and being coupled to the vapor injection cavity;

an inverter module mounted inside the housing and adapted to convert direct current electrical power to alternating current electrical power;

a motor mounted inside the housing and being coupled to the inverter module;

a drive shaft coupled to the motor; and, a compression device coupled to the drive shaft, for receiving the refrigerant from the intake volume and compressing the refrigerant as the drive shaft is rotated by the motor, the compression device including:

a fixed scroll located within the housing and being fixed thereto; and, an orbiting scroll coupled to the drive shaft, the orbiting scroll and the fixed scroll forming a compression chamber for receiving the refrigerant from the intake volume and compressing the refrigerant as the drive shaft is rotated about the center axis;

a valve plate adjacent the rear head and defining at least one plate groove, the at least one plate groove defining a vapor injection channel, a reed receiving portion, and an injection portion, the injection portion being fluidly coupled to the vapor injection cavity, the reed receiving portion positioned between the vapor injection channel and the injection portion, the vapor injection channel having a first end and a second end, the first end of the vapor injection channel being adjacent the reed receiving portion, the vapor injection channel including a vapor plate channel outlet aperture at the second end and being fluidly coupled to the compression chamber; and, a vapor reed mechanism positioned within the reed receiving portion of the plate groove and being configured to control flow of vapor from the vapor injection cavity through the vapor injection channel and the vapor plate channel outlet aperture to the compression chamber, wherein the rear head includes a rear head cavity, the rear head cavity being divided into the discharge volume and the vapor injection cavity by a series of partitions integral with the rear head.

13. The electric scroll compressor, as set forth in claim 12, wherein the at least one plate groove includes first and second plate grooves.

14. The electric scroll compressor, as set forth in claim 12, the series of partitions having a top surface adjacent the center housing.

15. The electric scroll compressor, as set forth in claim 14, wherein the valve plate is positioned adjacent the top surface of the series of partitions between the rear head and the fixed scroll.

16. The electric scroll compressor, as set forth in claim 15, wherein the series of partitions divides the discharge volume into a plurality of sub-chambers including a central sub-chamber, wherein the at least one plate groove includes first and second plate grooves formed within the valve plate on opposite sides of the central sub-chamber.

17. The electric scroll compressor, as set forth in claim 16, further including a gasket positioned between the center housing and the rear head and being configured to provide sealing between the discharge volume and the vapor injection cavity and vapor injection channels.

* * * * *